US006450387B1

(12) United States Patent
Chen

(10) Patent No.: US 6,450,387 B1
(45) Date of Patent: Sep. 17, 2002

(54) NAIL-DRIVING GUN WITH SAFETY DEVICE

(75) Inventor: Robert Chen, Tai-Ping (TW)

(73) Assignee: Panrex Industrial Co., Ltd., Tai-Ping (TW)

( * ) Notice: Subject to any disclaimer, the term of this patent is extended or adjusted under 35 U.S.C. 154(b) by 0 days.

(21) Appl. No.: 10/087,270

(22) Filed: Mar. 4, 2002

(51) Int. Cl.[7] ..... B25C 1/04
(52) U.S. Cl. ..... 227/8; 227/130
(58) Field of Search ..... 227/8, 130, 120, 227/142

(56) References Cited

U.S. PATENT DOCUMENTS 5,551,621 A * 9/1996 Vallee ..... 227/130
5,791,545 A * 8/1998 Lin ..... 227/130
5,836,501 A * 11/1998 Lai ..... 227/8
5,862,969 A * 1/1999 Lee ..... 227/8
6,059,161 A * 5/2000 Chang et al. ..... 227/130
6,116,488 A * 9/2000 Lee ..... 227/8
6,213,372 B1 * 4/2001 Chen ..... 227/8
6,357,647 B1 * 3/2002 Ou ..... 227/8

* cited by examiner

*Primary Examiner*—Scott A. Smith
(74) *Attorney, Agent, or Firm*—Ohlandt, Greeley, Ruggiero & Perle, L.L.P.

(57) ABSTRACT

A nail-driving gun includes a gun body that has a handle and a nail-shooting seat. A safety device includes an upper plate, a lower plate, and a safety rod. The upper and lower plates can move synchronously between top and bottom plates of the nail-shooting seat. The safety rod has a front end that is attached fixedly to a rear end portion of the assembly of the upper and lower plates. The upper and lower plates have front ends that project forward from the nail-shooting seat and that can be pressed against a wall so as to move the safety rod to a rear limit position, where the trigger member can be actuated to shoot a nail from the nail-shooting seat.

7 Claims, 8 Drawing Sheets

NAIL-DRIVING GUN WITH SAFETY DEVICE

BACKGROUND OF THE INVENTION

1. Field of the Invention

This invention relates to a nail-driving gun, and more particularly to a nail-driving gun having a safety device, which includes a safety rod that is movable between a front limit position, where nail shooting is prevented, and a rear limit position, where the nail shooting is permitted.

2. Description of the Related Art

Referring to FIG. 1, a conventional driving gun 10 is shown to include a handle 11, a barrel 12, a trigger member 13, a safety rod 14, and a nail case unit 15. The handle 11 is provided with a movable valve rod 111. The barrel 12 has a front portion that is provided with a nail-shooting seat 121, and a rear portion that is attached to an upper end of the handle 11. The trigger member 13 is mounted pivotally on the handle 11. A pushing plate 131 is connected pivotally to the trigger member 13. The safety rod 14 has a tubular front end 141 that is disposed around a front end of the nail-shooting seat 121, and a rear end 142. A free end of the pushing plate 131 is biased by a spring (not shown) to abut against the rear end 142 of the safety rod 14. The nail case unit 15 has a case body that is attached to the nail-shooting seat 121.

When the gun 10 is not in use, the safety rod 14 is biased by a spring (not shown) to a front limit position, where the pushing plate 131 is spaced apart from the valve rod 111 even when the trigger member 13 is pressed. When it is desired to shoot a nail from the gun 10, the front end 141 of the safety rod 14 is pressed against a wall, into which the nail is to be driven, so as to move the safety rod 14 to a rear limit position, where the rear end 142 of the safety rod 14 pushes rearward the free end of the pushing plate 131 so that the valve rod 111 can move rearward on the handle 11 when the trigger member 13 is pressed. As such, compressed air is fed into the nail-shooting seat 121, thereby shooting the nail from the front end 141 of the safety rod 14.

The safety rod 14 suffers from the following disadvantages:

(1) The safety rod 14 is relatively long, thereby hindering its smooth movement during operation.

(2) The safety rod 14 has a relatively long portion that extends outwardly of the nail-shooting seat 121, thereby affecting adversely the appearance of the gun 15.

(3) The front end 141 of the safety rod 14 has a relatively large cross-sectional area, thereby affecting utility of the gun 15.

SUMMARY OF THE INVENTION

An object of this invention is to provide a nail-driving gun, which includes a safety device that can move smoothly during operation.

Another object of this invention is to provide a nail-driving gun, which includes a safety device that is concealed within a nail-shooting seat except for a front end, thereby improving the appearance of the gun.

Still another object of this invention is to provide a safety device for a nail-driving gun, which has a portion that is to be pressed against a wall and that has a relatively small cross-sectional area, thereby enhancing utility of the gun.

According to this invention, a nail-driving gun includes a gun body that has a handle and a nail-shooting seat. A safety device includes an upper plate, a lower plate, and a safety rod. The upper and lower plates can move synchronously between top and bottom plates of the nail-shooting seat. The safety rod has a front end that is attached fixedly to a rear end portion of the assembly of the upper and lower plates. The upper and lower plates have front ends that project forward from the nail-shooting seat and that can be pressed against a wall so as to move the safety rod to a rear limit position, where the trigger member can be actuated to shoot a nail from the nail-shooting seat.

Because the safety rod is relatively short, it can move smoothly during operation.

Moreover, the portions of the upper and lower plates other than their front ends are concealed between the top and bottom plates of the nail-shooting seat, thereby improving the appearance of the gun.

In addition, a front end of the assembly of the upper and lower plates of the safety device is relatively thin, thereby enhancing utility of the gun.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENT

Figure 1:
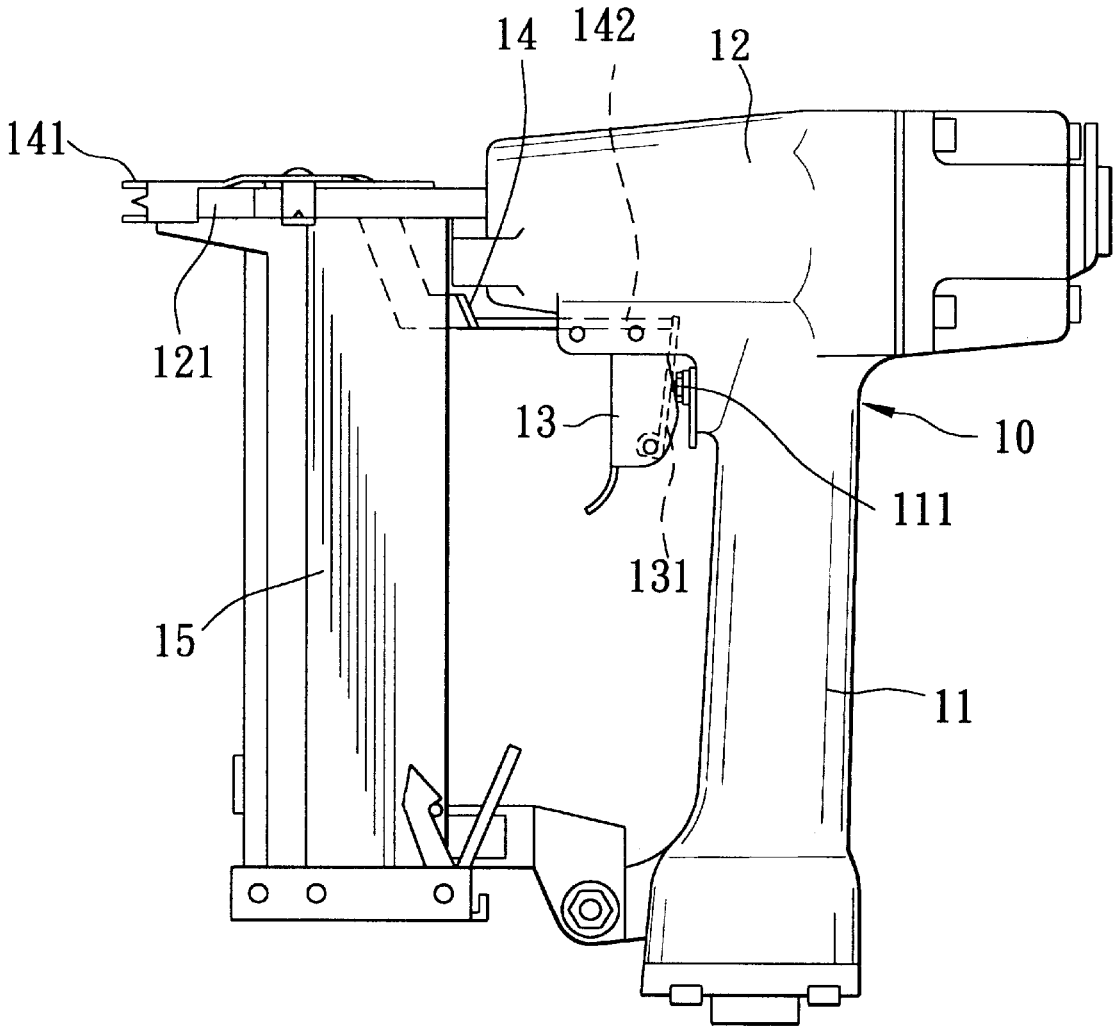
FIG. 1 PRIOR ART
FIG. 1 is a schematic view of a conventional nail-driving gun, illustrating a safety rod when disposed at a front limit position.
Figure 2:
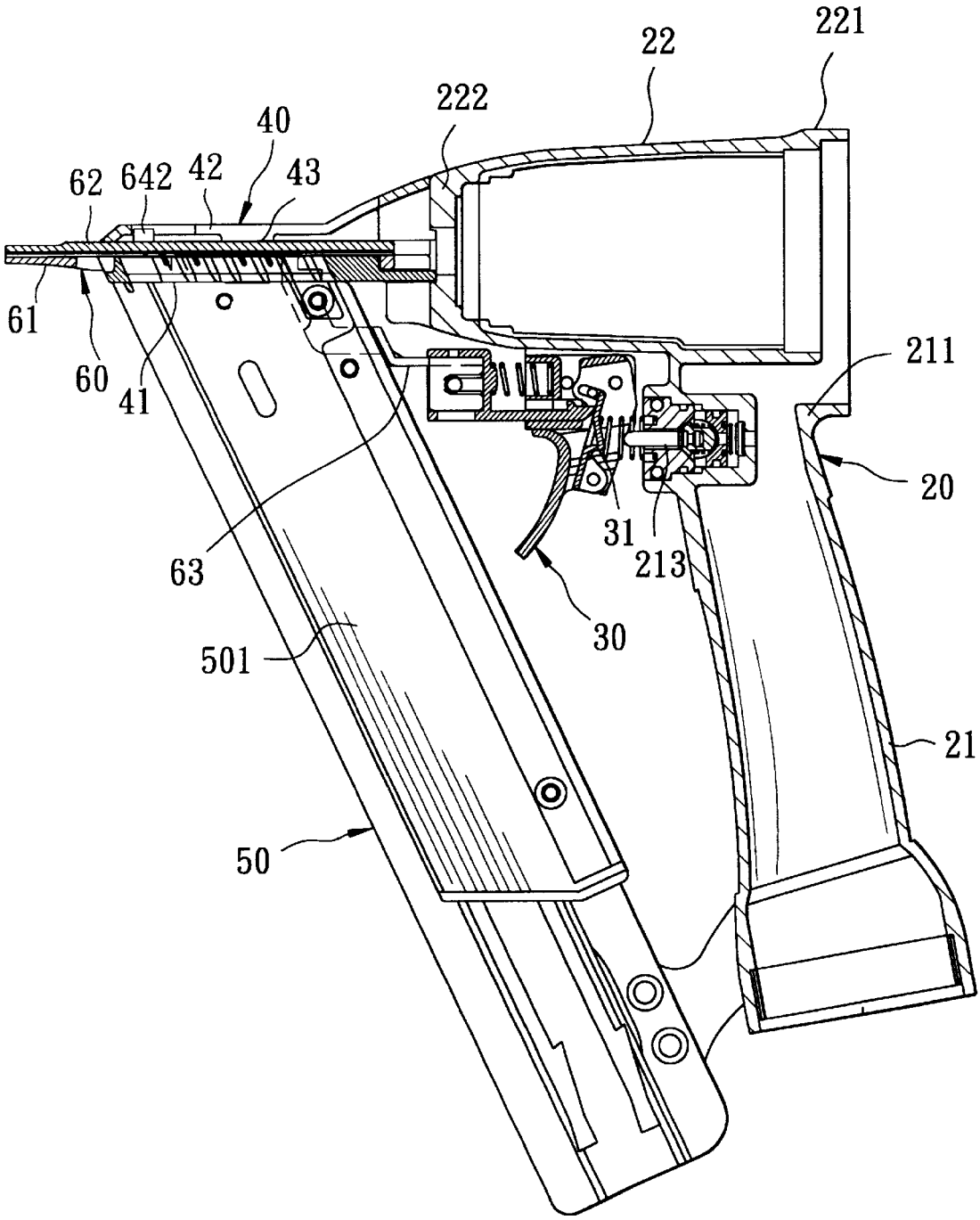
FIG. 2 .is a schematic partly sectional view of the preferred embodiment of a nail-driving gun according to this invention, illustrating a safety rod when disposed at a front limit position.

Referring to FIG. 2, the preferred embodiment of a nail-driving gun according to this invention is shown to include a gun body 20, a trigger member 30, a nail-shooting seat 40, a nail case unit 50, and a safety device 60.

The gun body 20 includes a handle 21 and an air cylinder 22. The handle 21 has an upper end 211 that is attached to a rear end 221 of the air cylinder 22, and a movable valve rod 213 that is operably associated with the air cylinder 22 and the nail-shooting seat 40 in a known manner and that is operable so as to permit flow of compressed air into the nail-shooting seat 40 for nail shooting.

The trigger member 30 is disposed swingably on the handle 21. A spring-loaded pushing plate 31 is connected pivotally to the trigger member 30.

The nail-shooting seat 40 is connected fixedly to a front end 222 of the air cylinder 22, and has a bottom plate 41 and a top plate 42, between which a slide slot 43 is defined. Four bolts 44 (only two are shown in FIG. 3) extend through holes in the top plate 42 to engage four threaded holes that are formed respectively in four integral upward projections 412, 413, 414, 415 on the bottom plate 41, thereby fixing the top plate 42 to the bottom plate 41.

The nail case unit 50 includes a case body 501 that is attached fixedly to the bottom plate 41 of the nail-shooting seat 40 and that is adapted to receive a row of nails (not shown) in a known manner.

Figure 3:
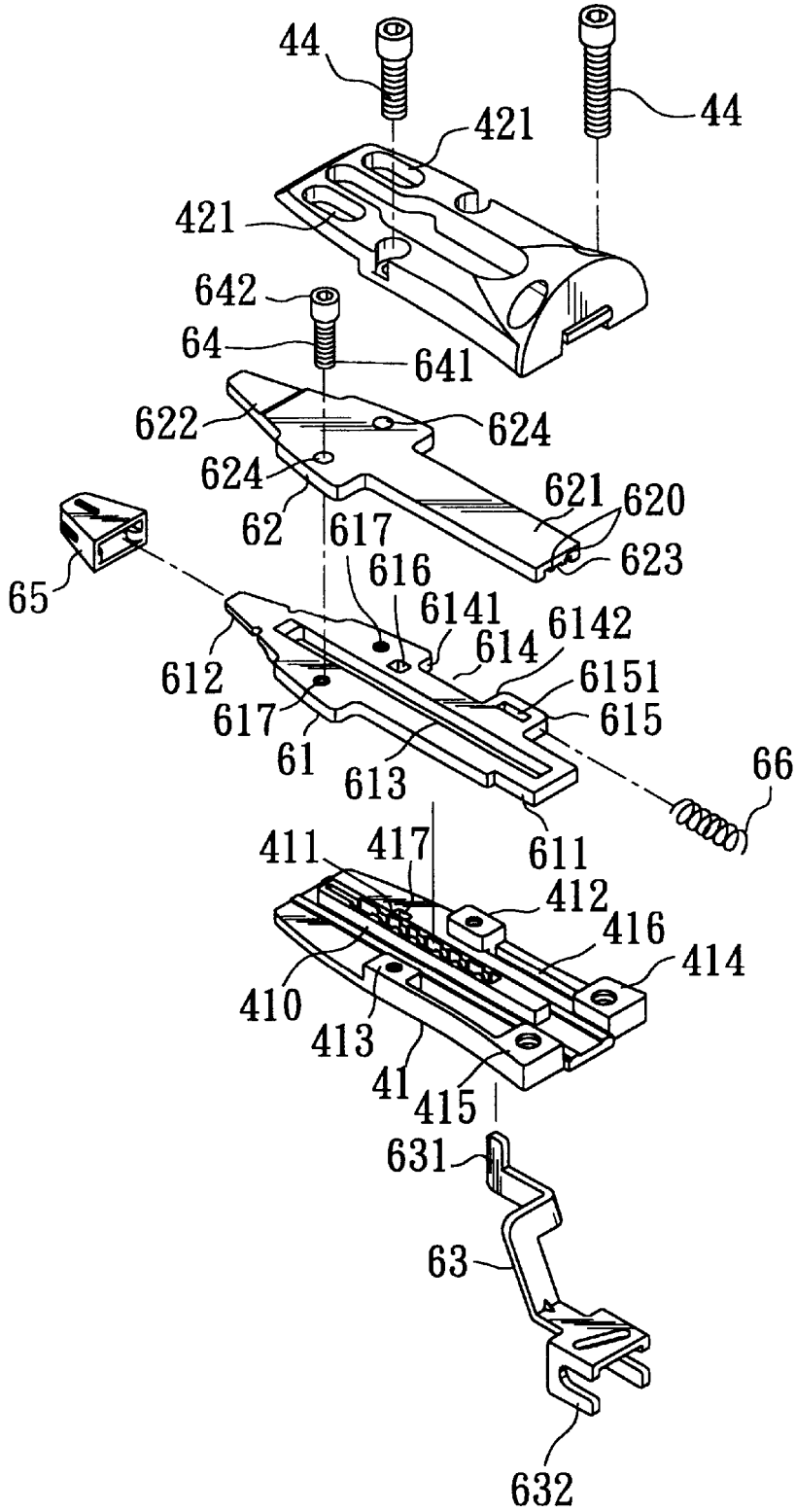
FIG. 3 is an exploded perspective view of a safety device and a nail-shooting seat of the preferred embodiment.
Figure 4:
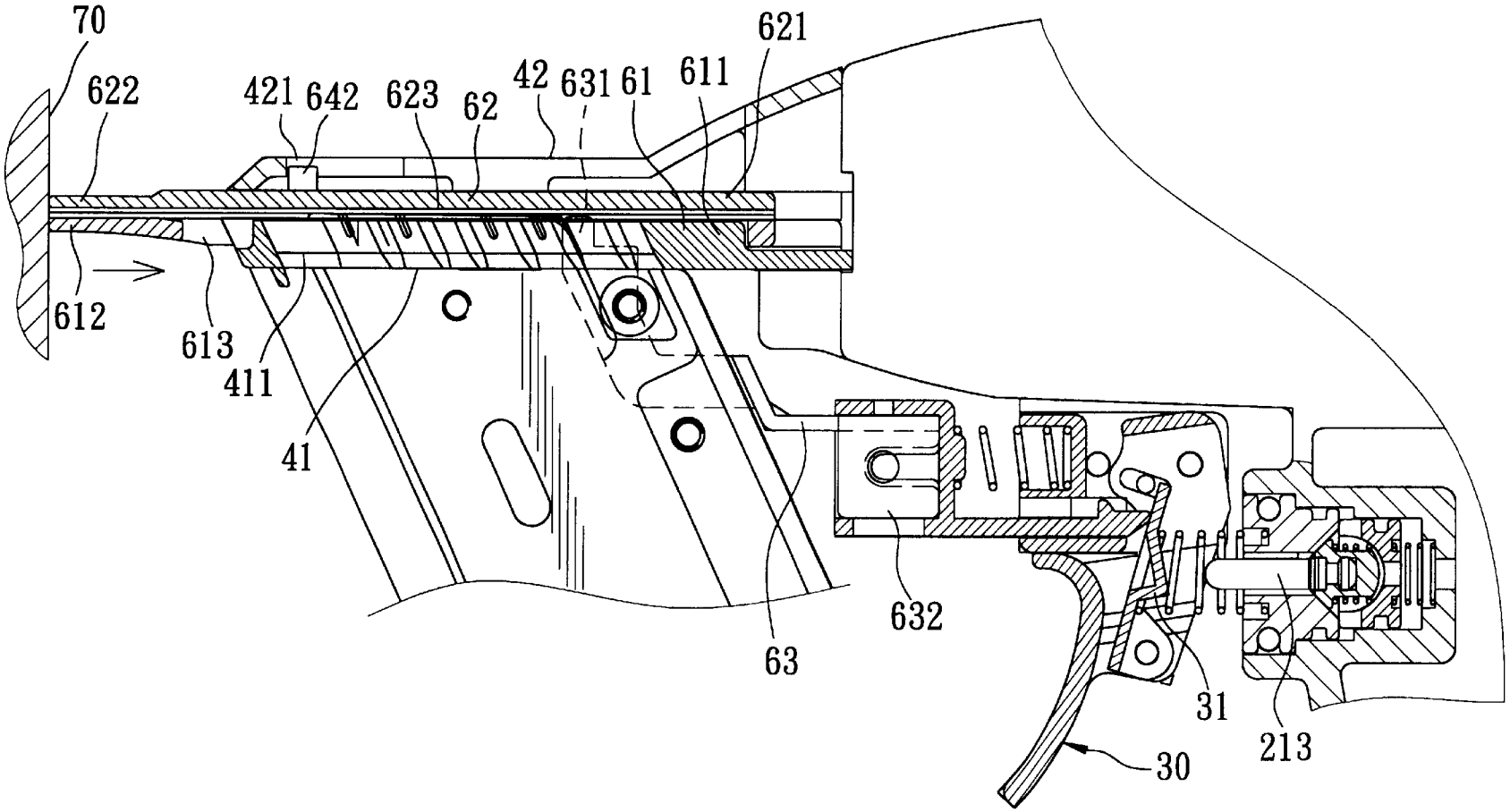
FIG. 4 is a fragmentary, schematic partly sectional view of the preferred embodiment, illustrating the safety device.

Referring to FIGS. 2, 3, and 4, the safety device 60 includes a pair of superposed lower and upper plates 61, 62 that are disposed movably within the slide slot 43 in the nail-shooting seat 40, and a safety rod 63. Each of the upper and lower plates 62, 61 is elongated, and has a rear end 611, 621 and a front end 612, 622 that projects forward from the nail-shooting seat 40 and that is press-fitted within a common cap 66.

A front end 631 of the safety rod 63 is perpendicular to the lower plate 61, and extends through a longitudinal slot 416 in the bottom plate 41 to engage fittingly a rod hole 6151 in a rear end portion of the lower plate 61 so as to move synchronously with the lower plate 61 along the longitudinal slot 416 in the bottom plate 41.

Figure 2A:
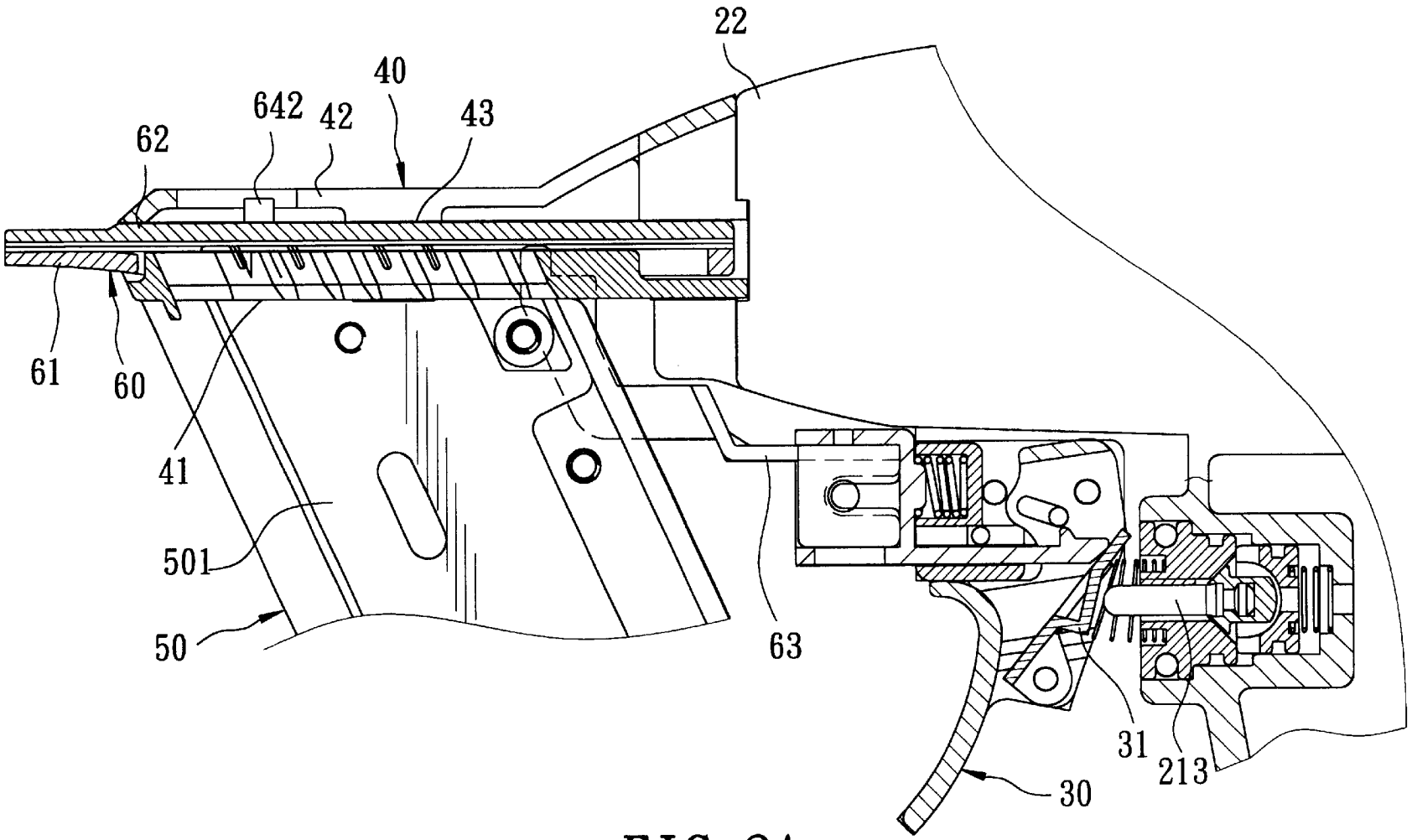
FIG. 2A is a fragmentary, schematic partly sectional view of the preferred embodiment, illustrating the safety rod when disposed at a rear limit position.

The pushing plate 31 is biased to abut against a rear end 632 of the safety rod 63. The safety rod 63 is movable relative to the handle 21 between a front limit position shown in FIG. 2, where the pushing plate 31 is positioned so as to prevent contact between the pushing plate 31 and the valve rod 213 even when the trigger member 30 is actuated, and a rear limit position shown in FIG. 2A, where the rear end 632 of the safety rod 63 pushes the pushing plate 31 rearward so that the pushing plate 31 can move the valve rod 213 rearward when the trigger member 30 is actuated, thereby permitting shooting of one of the nails from the nail-shooting seat 40. A coiled compression spring 66 is used for biasing the safety rod 63 to the front limit position.

The lower plate 61 has a longitudinal slot 613 formed therethrough. The bottom plate 41 is formed with an integral guide rail 410 which is received slidably within the longitudinal slot 613 in the lower plate 61 and which is formed with a nail opening 411 that is communicated with a nail passage (not shown) in the case body 501 of the nail case unit 50. The upper plate 62 is located over the lower plate 61, and is formed with two downwardly projecting ribs 620 that define a nail flyway 623 therebetween and that is communicated with the nail opening 411 in the bottom plate 41. Accordingly, the nails can be moved from the case body 501 of the nail case unit 50 to the nail flyway 623 via the nail opening 411 in the bottom plate 41 one at a time.

The upper plate 62 is formed with two holes 624. The lower plate 61 is formed with two threaded holes 617. The top plate 42 is formed with two guide slots 421 that extend in a direction parallel to the nail flyway 623 in the upper plate 62 and that have closed front and rear ends. The safety device 60 further includes two bolts 64 which have threaded portions 641 that extend through the holes 624 in the upper plate 62 to engage the threaded holes 617 in the lower plate 61, and heads 642 that are received respectively and movably within the slots 421 in the top plate 42 so as to guide synchronous forward and rearward movement of the upper and lower plates 62, 61 relative to the top plate 42 in a longitudinal direction of the lower plate 61.

Figure 5:
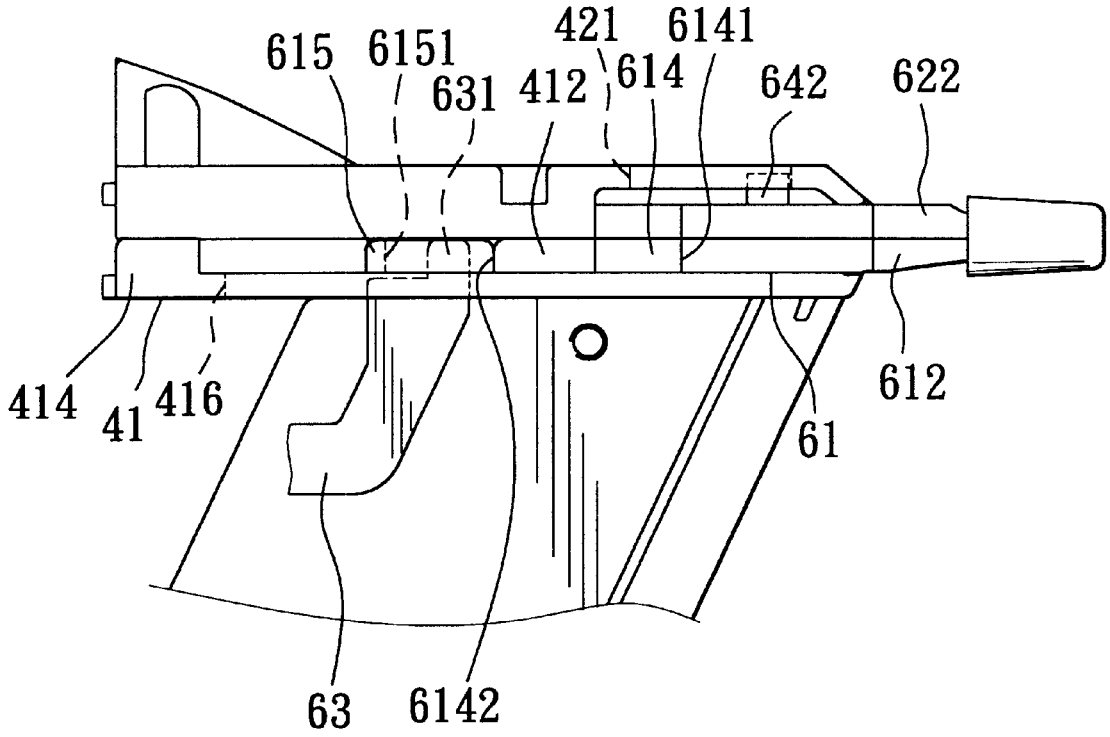
FIG. 5 is a fragmentary schematic side view of the preferred embodiment, illustrating a pair of upper and lower plates of the safety device of the preferred embodiment when disposed at their normal positions.
Figure 6:
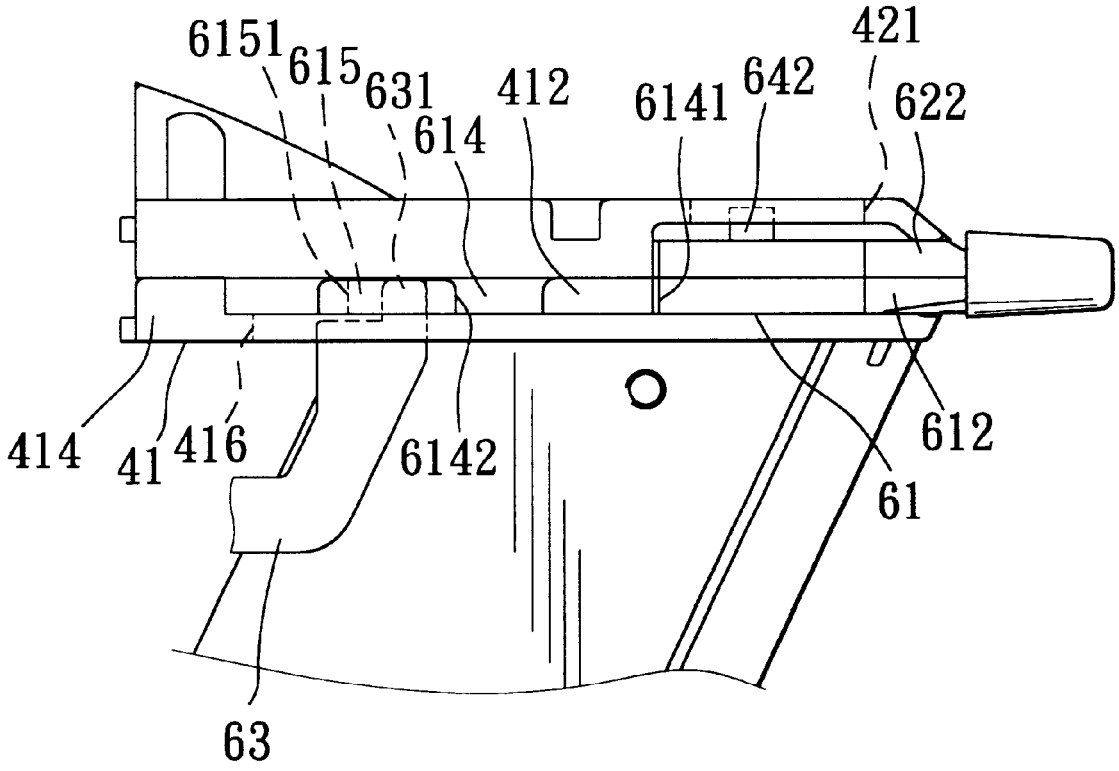
FIG. 6 is a fragmentary schematic side view of the preferred embodiment, illustrating how the upper and lower plates are actuated so as to move the safety rod from the front limit position to the rear limit position.

The lower plate 61 is formed with a limiting notch 614 that is defined by a front side wall 6141 and a rear side wall 6142. The upward projection 412 of the bottom plate 41 is received slidably within the notch 614 in the lower plate 61, and abuts against the rear side wall 6142 when the safety rod 63 is in the front limit position, as shown in FIG. 5, and against the front side wall 6141 when the safety rod 63 is in the rear limit position, as shown in FIG. 6. As such, the safety rod 63 is limited to move between the front and rear limit positions.

Figure 7:
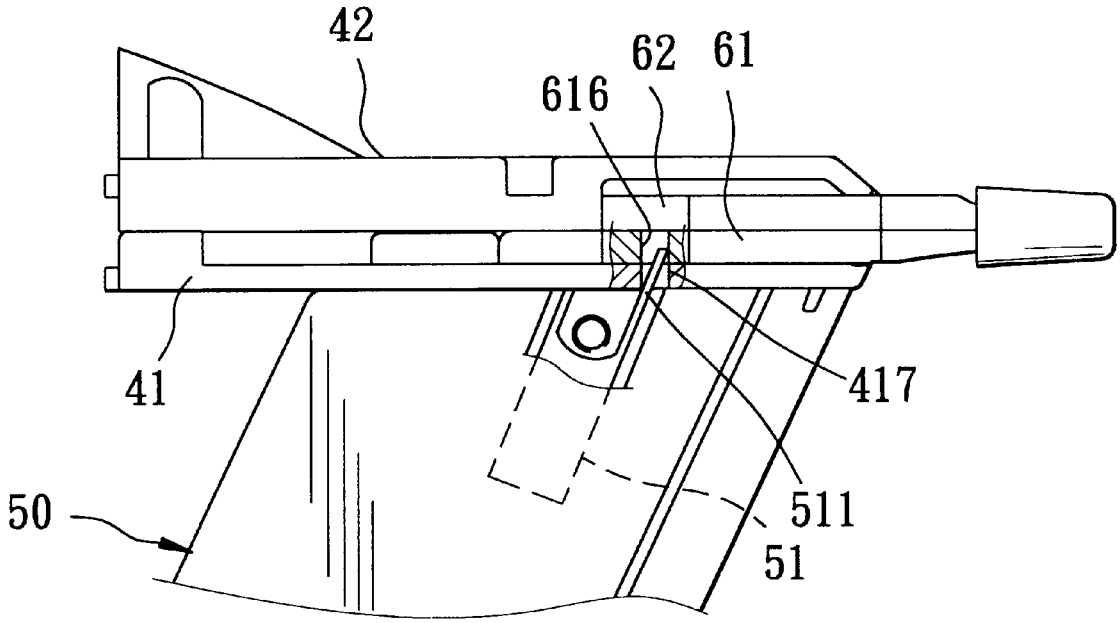
FIG. 7 is a fragmentary schematic side view of the preferred embodiment, illustrating how the upper and lower plates are retained at their normal positions when no nail is disposed within a nail case unit.

Referring to FIGS. 3 and 7, each of the lower and bottom plates 61, 41 is formed with a pin hole 616, 417. A nail-pushing member 51 is disposed movably within the case body 501, and is operable so as to push the nails into the nail opening 411 in the bottom plate 41 one by one. The nail-pushing member 51 is formed with an integral stop pin 511 that is movable into the pin holes 616, 417 in the lower and bottom plates 61, 41 when the case body 501 of the nail case unit 50 has emptied of the nails, thereby preventing movement of the lower plate 61 relative to the bottom plate 41.

The lower plate 61 has a side which is formed with an integral lateral projection 615 and which is disposed in front of the upward projection 414 on the bottom plate 41. The spring 66 is confined between the lateral projection 615 of the lower plate 61 and the upward projection 414 of the bottom plate 41 so as to bias the lateral projection 615 forward and away from the upward projection 414, thereby retaining the safety rod 63 at the front limit position.

The nail-driving gun of this invention has the following advantages:

(1) Because the safety rod 63 is relatively short, it can move smoothly during operation.

(2) The portions of the upper and lower plates 62, 61 other than the front ends 621, 611 are concealed between the top and bottom plates 42, 41 of the nail-shooting seat 40, thereby improving the appearance of the gun.

(3) The front ends 621, 611 of the upper and lower plates 62, 61 are relatively thin, thereby enhancing utility of the gun.

With this invention thus explained, it is apparent that numerous modifications and variations can be made without departing the scope and spirit of this invention. It is therefore intended that this invention be limited only as indicated by the appended claims.

I claim:

1. A nail-driving gun comprising:

a gun body including a handle, a nail-shooting seat disposed in front of said handle and having a bottom plate and a top plate, between which a slide slot is defined, a valve rod disposed movably on said handle and movable relative to said handle so as to be adapted to permit flow of compressed air into said nail-shooting seat for nail shooting, a trigger member disposed swingably on said handle, and a pushing plate connected pivotally to said trigger member;

a nail case unit including a case body that is attached fixedly to said bottom plate of said nail-shooting seat and that is adapted to receive a row of nails, said nail case unit being adapted to be operable so as to feed said nails into said nail-shooting seat one at a time; and a safety device including a pair of superposed upper and lower plates disposed movably within said slide slot in said nail-shooting seat, each of said upper and lower plates having a rear end and a front end that projects forward from said nail-shooting seat, said upper and lower plates being fixed relative to each other and defining a nail flyway therebetween that is adapted to receive the nails from said nail case unit one at a time and that is adapted to shoot the nails individually therefrom, a safety rod having a front end that is attached to assembly of said rear ends of said upper and lower plates so as to move synchronously therewith relative to said handle, and a rear end that is brought into contact with said pushing plate and that is movable relative to said handle between a front limit position, where said pushing plate is positioned so as to prevent contact between said pushing plate and said valve rod even when said trigger member is actuated, and a rear limit position, where said safety rod pushes said pushing plate rearward so that said pushing plate can move said valve rod rearward when said trigger member is actuated, thereby permitting shooting of the nails from said nail flyway, and a spring for biasing said safety rod to said front limit position.

2. The nail-driving gun as claimed in claim 1, wherein said lower plate is elongated, and further has a longitudinal slot that is formed therethrough, said bottom plate including an integral guide rail which is received slidably within said longitudinal slot in said lower plate and which is formed with a nail opening, said upper plate being located over said lower plate and being formed with two downwardly projecting ribs that define said nail flyway therebetween and that is communicated with said nail opening in said bottom plate so as to be adapted to permit movement of the nails from said case body of said nail case unit to said nail flyway via said nail opening in said bottom plate.

3. The nail-driving gun as claimed in claim 1, wherein said upper plate is formed with two holes, said lower plate being formed with two threaded holes, said top plate being formed with two guide slots that extend in a direction parallel to said nail flyway and that have closed front and rear ends, said safety device further including two bolts which have threaded portions that extend through said holes in said upper plate to engage said threaded holes in said lower plates, and heads that are received respectively and movably within said guide slots in said top plate so as to guide synchronous forward and rearward movement of said upper and lower plates relative to said top plate in a longitudinal direction of said lower plate.

4. The nail-driving gun as claimed in claim 1, wherein said lower plate is formed with a limiting notch that is defined by a front side wall and a rear side wall, said bottom plate being formed with an integral upward projection that is received slidably within said notch and that abuts against said rear side wall when said safety rod is in said front limit position and against said front side wall when said safety rod is in said rear limit position.

5. The nail-driving gun as claimed in claim 1, wherein each of said lower plate and said bottom plate is formed with a pin hole, said nail case unit further including a nail-pushing member which is disposed movably within said case body and which is operable so as to be adapted to push the nails into said nail opening in said bottom plate one at a time, said nail-pushing member being formed with an integral stop pin that is movable into said pin holes in said lower and bottom plates when said case body has been emptied of the nails, thereby preventing movement of said lower plate relative to said bottom plate.

6. The nail-driving gun as claimed in claim 1, wherein said bottom plate is elongated, and has a longitudinal slot, said lower plate having a rear end portion that is formed with a rod hole, said front end of said safety rod being perpendicular to said lower plate, and extending through said longitudinal slot in said bottom plate to engage fittingly said rod hole in said lower plate so as to move synchronously with said lower plate along said longitudinal slot in said bottom plate.

7. The nail-driving gun as claimed in claim 1, wherein said lower plate has a side that is formed with an integral lateral projection, said bottom plate having a top surface which is formed with an integral upward projection that is disposed behind said lateral projection, said spring being configured as a coiled compression spring that is confined between said lateral projection and said upward projection so as to bias said lateral projection forward and away from said upward projection, thereby retaining said safety rod at said front limit position.

* * * * *